US012680442B2

(12) United States Patent
Ge et al.

(10) Patent No.: US 12,680,442 B2
(45) Date of Patent: Jul. 14, 2026

(54) PROCESSING AND JOINT INTERPRETATION USING MULTIPLE BOREHOLE ACOUSTIC WAVES FOR THROUGH TUBING CEMENT EVALUATION

(71) Applicant: Halliburton Energy Services, Inc., Houston, TX (US)

(72) Inventors: Yao Ge, Singapore (SG); Ruijia Wang, Singapore (SG); Brenno Caetano Troca Cabella, Rio de Janeiro (BR); Xiang Wu, Singapore (SG); Chung Chang, Houston, TX (US); Ho Yin Ma, Houston, TX (US); Jing Jin, Singapore (SG); Marco Aurelio Luzio, Rio de Janeiro (BR); Otto Fanini, Houston, TX (US); Gary Wayne Kainer, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 164 days.

(21) Appl. No.: 18/693,459

(22) PCT Filed: May 2, 2022

(86) PCT No.: PCT/US2022/027260
§ 371 (c)(1),
(2) Date: Mar. 19, 2024

(87) PCT Pub. No.: WO2023/075849
PCT Pub. Date: May 4, 2023

(65) Prior Publication Data

US 2024/0392679 A1 Nov. 28, 2024

Related U.S. Application Data

(60) Provisional application No. 63/272,815, filed on Oct. 28, 2021.

(51) Int. Cl.
*E21B 47/005* (2012.01)
*E21B 47/085* (2012.01)

(52) U.S. Cl.
CPC ..... *E21B 47/005* (2020.05); *E21B 47/085* (2020.05); *E21B 2200/22* (2020.05)

(58) Field of Classification Search
CPC ... E21B 47/005; E21B 47/085; E21B 2200/22
See application file for complete search history.

(56) References Cited

U.S. PATENT DOCUMENTS 4,255,798 A * 3/1981 Havira ..... E21B 47/005 367/32
11,592,591 B2 2/2023 Cabella et al.
(Continued)

FOREIGN PATENT DOCUMENTS

EP 3168412 A1 5/2017
WO 2023075849 A1 5/2023

OTHER PUBLICATIONS

Foreign Communication from Related Application—International Search Report and Written Opinion of the International Searching Authority, International Application No. PCT/US2022/027260, dated May 2, 2022, 9 pages.
(Continued)

*Primary Examiner* — Abdallah Abulaban
(74) *Attorney, Agent, or Firm* — Conley Rose, P.C.; Rodney B. Carroll

(57) ABSTRACT

A method of through tubing cement evaluation includes obtaining acoustic cement bond evaluation data relating to a property of a cement bond of a cased-borehole for each of a plurality of acoustic methods, wherein the acoustic cement bond evaluation data comprises a quality control (QC) value indicative of a confidence level of cement bonding condition, determining an eccentricity value of a tubing relative to a casing in the borehole, determining an output of each
(Continued)

acoustic method by combining the eccentricity value and the acoustic cement evaluation data associated with each acoustic method, combining the output of each acoustic method to generate an optimized cement bonding index log of the cement bond, and employing the optimized cement bonding index log to provide an interpretation of an overall cement bonding condition.

20 Claims, 11 Drawing Sheets

(56) References Cited

U.S. PATENT DOCUMENTS

| | | | | |
|---|---|---|---|---|
| 11,662,496 | B2 | 5/2023 | Cabella et al. | |
| 11,970,931 | B2 | 4/2024 | Ge et al. | |
| 2011/0240302 | A1* | 10/2011 | Coludrovich, III | E21B 37/00 166/336 |
| 2015/0219780 | A1 | 8/2015 | Zeroug et al. | |
| 2017/0226844 | A1* | 8/2017 | Izuhara | E21B 47/005 |
| 2020/0033494 | A1* | 1/2020 | Patterson | E21B 49/00 |
| 2020/0116007 | A1 | 4/2020 | Mandal | |
| 2022/0043179 | A1* | 2/2022 | Ghosh | E21B 47/006 |
| 2023/0175386 | A1 | 6/2023 | Ge et al. | |
| 2023/0175391 | A1 | 6/2023 | Cabella et al. | |
| 2023/0194743 | A1 | 6/2023 | Wang et al. | |

OTHER PUBLICATIONS

Song et al. Cement Bond Evaluation Method in Horizontal Wells Using Segmented Bond Tool. Geophysical Journal International. Feb. 6, 2018 vol. 213, Issue 3, pp. 1492-1502 and figures 1-5.

Filing Receipt, Specification and Drawings for U.S. Appl. No. 63/272,815, filed Oct. 28, 2021, entitled "Processing and Joint Interpretation Using Multiple Borehole Acoustic Waves for Through Tubing Cement Evaluation," 42 pages.

* cited by examiner

PROCESSING AND JOINT INTERPRETATION USING MULTIPLE BOREHOLE ACOUSTIC WAVES FOR THROUGH TUBING CEMENT EVALUATION

CROSS-REFERENCE TO RELATED APPLICATIONS

This application is a filing under 35 U.S.C. 371 of International Application No PCT/US2022/027260 filed May 2, 2022, entitled "Processing and Joint Interpretation Using Multiple Borehole Acoustic Waves for Through Tubing Cement Evaluation", which claims priority to U.S. Provisional Application No. 63/272,815 filed on Oct. 28, 2021, which is are hereby incorporated by reference in their entirety.

TECHNICAL FIELD

The present invention relates generally to apparatus and methods related to oil and gas exploration.

BACKGROUND

Multiple acoustic methods have been developed for the through tubing cement evaluation application. The acoustic methods may include an adjacent differential method, a polar differential method, a borehole resonance mode method, or a casing guided waves method. However, these acoustic methods may have varying performance in various aspects such as azimuthal or vertical resolution, border detection, eccentricity robustness, etc. Because of the varying performance, the acoustic methods may offer separate cement evaluation logs measuring the same physical property. However, reading multiple logs may be challenging for a user especially one without knowledge of the principle of each acoustic method. These challenges are crucial to be addressed.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Aspects of the present disclosure involve systems and methods for combining results of acoustic measurements of multiple acoustic methods to produce an optimized cement bonding index log for through tubing cement evaluation. The disclosed systems and methods may combine the results of different acoustic measurements on the same physical property (e.g., acoustic impedance of a material behind casing or a percentage of cement bonding at each depth) to produce an optimized log that removes ambiguity and provides a joint interpretation of the acoustic measurements. In some embodiments, during the processing, a result from one acoustic method may be used as an input to another acoustic method to significantly improve the result of the other acoustic method. In some embodiments, the disclosed methods may use a physical-based empirical equation to combine the multiple acoustic methods. In one implementation, the physical-based empirical equation may be a weighted sum of bond index (BI) values (as weights) associated with each acoustic method. In another implementation, a machine learning model may be employed to generate physical-based empirical equation.

The disclosure may describe a method to jointly process and interpret the results of multiple acoustic methods for the through tubing cement evaluation application. The disclosed methods may save the time, cost, and resources of the users by providing combined information (i.e. an optimized cement bonding index log) about the cement bonding condition. Example methods and systems disclosed may also help in improving the final product quality by applying quality control filters, removing ambiguity, and aiding untrained users in log quality control. Furthermore, the combined information about the cement bonding condition may determine the quality of the cementing operation, the necessity for repairs, or an improvement for future wells to make critical downhole choices with confidence.

Figure 1:
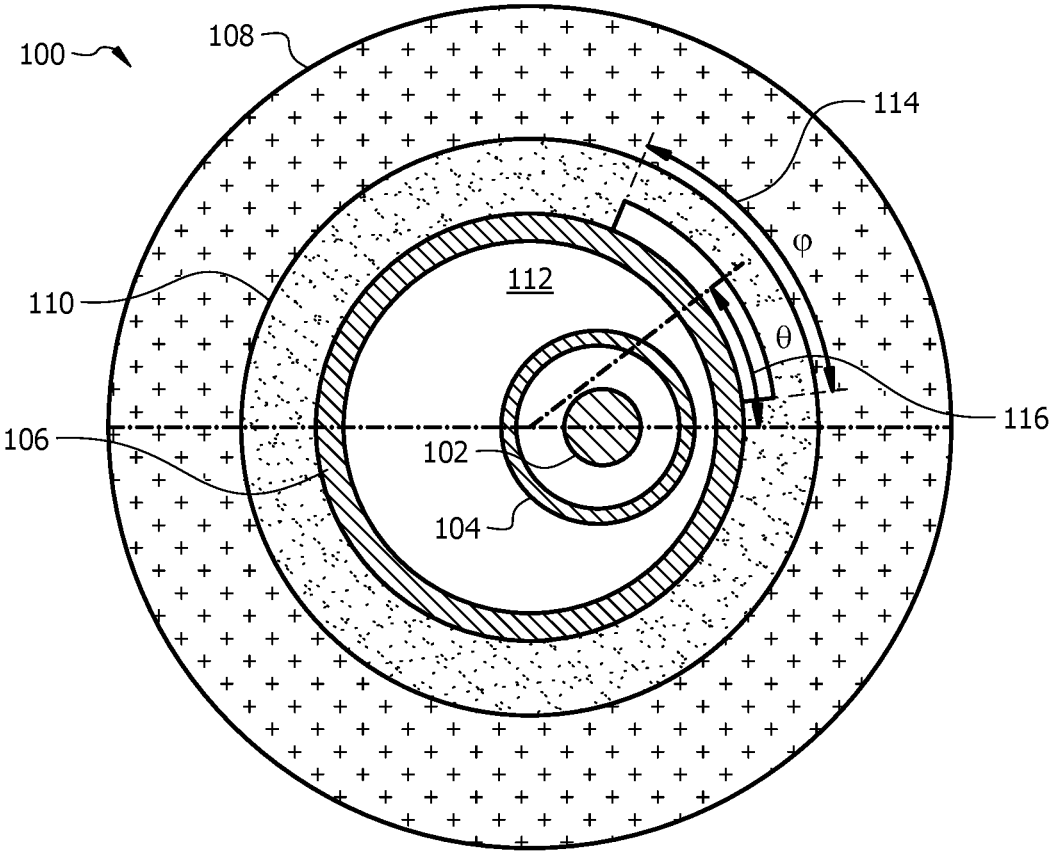
FIG. 1 illustrates a schematic diagram of tubing/casing configuration of an acoustic logging tool deployed in a borehole and cement bonding conditions for through tubing cement evaluation application, in accordance with embodiments of the present disclosure.

FIG. 1 illustrates a schematic diagram of tubing/casing configuration of an acoustic logging tool 102 deployed in a borehole/wellbore and cement bonding conditions for through tubing cement evaluation application, in accordance with embodiments of the present disclosure. In one implementation, the acoustic logging tool 102, tubing (a.k.a production tube) 104, and casing 106 may be located in the borehole formed in a subterranean formation 108. Cement 110 may fill an annulus formed between the casing 106 and the formation 108 to secure the casing 106 within the borehole. An angular section of the annulus between the acoustic logging tool 102, the tubing 104, and the casing 106 is a channel in the casing that may be filled with the fluid 112 instead of cement 110. Thus, the channel may be an elongated path within a cement layer in which cement is absent. An angle phi (φ) 114 may provide a size of the channel and an angle theta (θ) 116 may provide a channel direction relative to 0° (positive X direction), which is also the default eccentricity direction. The cement 110 may be bonded between the casing 106 and the formation 108. The quality of the cement bonding in the angular section may vary along the depth of the borehole. Along the depth of the borehole, the nature of the cement bonding may range from no bonding, that is, the tubing 104 is free of bonding to the cement 110 (e.g., free casing), complete bonding such that the tubing 104 is bound to the cement or other materials, or partial bonding. One physical characteristic that is used to represent the integrity of the cement may be the bond index (BI). BI is a qualitative measurement of cement adhesion to the exterior casing wall, where a BI value of 1.0 represents a perfect cement bond and whereas a BI value of 0 represents no adhesion.

The acoustic logging tool 102 may be centralized in the tubing 104 with a centralizer. The tubing 104 may not be centered in the casing 106 and may be eccentric due to the curvature of the tubing or well inclination. The eccentricity may be evaluated as the offset of the tubing 104 from casing center divided by the centered annulus thickness between the tubing 104 and the casing 106. The eccentricity may be measured by a percentage. The eccentricity value of 0% indicates that the tubing 104 is centered in the casing 106 and an eccentricity value of 100% indicates that the tubing 104 is touching the wall of the casing 106.

In one implementation, the acoustic logging tool 102 may comprise one or more transmitters to transmit acoustic waves which interact with the borehole, and one or more receivers to receive the transmitted acoustic waves. In some examples, the transmitter may include any suitable acoustic source for generating acoustic waves downhole, including, but not limited to, a monopole transmitter, a cross dipole transmitter (e.g., two dipole transmitters orthogonal to each other), and a unipole transmitter. In some examples, the receivers may include acoustic receiver suitable for use downhole, including array receivers in the azimuthal direction and the axial direction that may convert the transmitted acoustic waves into an electric signal. Additionally, the transmitters and receivers may be located on either a fixed section or a rotating section of the acoustic logging tool 102. The transmitters and receivers may be selected in different combinations for each acoustic method as outlined below.

Transmission of acoustic waves by the transmitter and the recordation of signals by the receivers may be controlled by a display and storage unit, which may include an information handling system. The information handling system may be a component of the display and storage unit. Alternatively, the information handling system may be a component of the acoustic logging tool 102. In some examples, the information handling system may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. Information handling system may include a processing unit (e.g., microprocessor, central processing unit, etc.) that may process acoustic cement evaluation log data by executing software or instructions obtained from a local non-transitory computer readable media (e.g., optical disks, magnetic disks). The non-transitory computer readable media may store software or instructions of the methods described herein. Non-transitory computer readable media may include any instrumentality or aggregation of instrumentalities that may retain data and/or instructions for a period of time. Non-transitory computer readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. In some examples, the information handling system may also include input device(s) (e.g., keyboard, mouse, touchpad, etc.) and output device(s) (e.g., monitor, printer, etc.). The input device(s) and output device(s) provide a user interface that enables an operator to interact with the acoustic logging tool 102 and/or software executed by a processing unit. For example, the information handling system may enable an operator to select analysis options, view collected log data, view analysis results, and/or perform other tasks.

Furthermore, the acoustic logging tool 102 may be operatively coupled to a conveyance (e.g., wireline, slickline, coiled tubing, pipe, downhole tractor, and/or the like) which may provide mechanical suspension, as well as electrical connectivity, for the acoustic logging tool 102. In some embodiments, the conveyance and the acoustic logging tool 102 may extend within the casing 106 to a desired depth within the borehole. Signals/acoustic waves recorded by the acoustic logging tool 102 may be stored on memory and then processed by the display and storage unit after recovery of the acoustic logging tool 102 from the borehole. Alternatively, signals recorded by the acoustic logging tool 102 may be conducted to the display and storage unit by way of the conveyance. The display and storage unit may process the signals, and the information contained therein may be displayed for an operator to observe and stored for future processing and reference. Alternatively, signals may be processed downhole prior to receipt by the display and storage unit or both downhole and at surface, for example, by the display and storage unit. In some examples, the display and storage unit may also contain an apparatus for supplying control signals and power to the acoustic logging tool 102. Typical casing string may extend from wellhead at or above ground level to a selected depth within the borehole.

Various acoustic methods may be employed for cement bonding evaluation. These methods may include an adjacent differential method, a polar differential method, a borehole resonance method, or a casing guided waves method as outlined below.

Figure 2A:
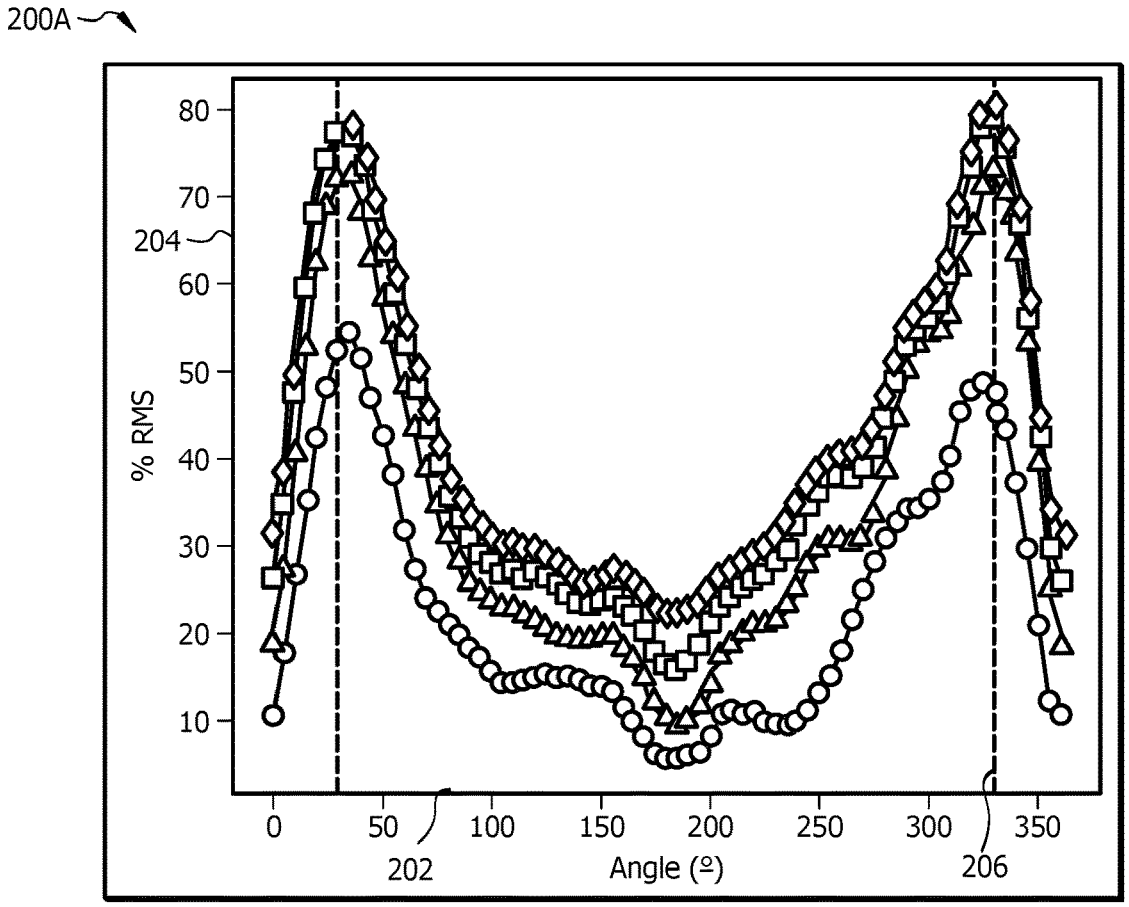
FIG. 2A illustrates results of an adjacent differential method applied to a data set, in accordance with embodiments of the present disclosure.

FIG. 2A illustrates result 200A of an adjacent differential method applied to a data set with 60° channel direction centered at 0° to determine material properties including material discontinuities that may be caused by channels within borehole cement layers, in accordance with embodiments of the present disclosure. The adjacent differential method may accurately and efficiently determine the horizontal and vertical locations of material transition boundaries such as cement boundaries/borders of channels within a cement layer. In FIG. 2A, x-axis 202 may represent an angle with 60° channel direction centered at 0°, and y-axis 204 may represent peaks of the root mean square (RMS) (%) values related to channel borders location 206. Different curves may represent different parameters (e.g., time window and/or number of neighbors) used to evaluate cement bonding. The adjacent differential processing method may comprise comparing the characteristics of adjacent neighbors' time series and associating their differences to transitions between dissimilar materials behind the casing 110. The adjacent differential processing method may utilize the measurements of adjoining azimuth angles to verify whether there exists a distinction between the materials (i.e., fluid-filled channel vs. cement) on the opposite (external) side of the casing on either side of the reference azimuth. The method may be applied to different wave motions, echoes, zero-order symmetrical mode (designated S0) guided waves, and zero-order antisymmetric mode (designated A0) guided waves, or even higher-order symmetric and asymmetric lamb waves.

Figure 2B:
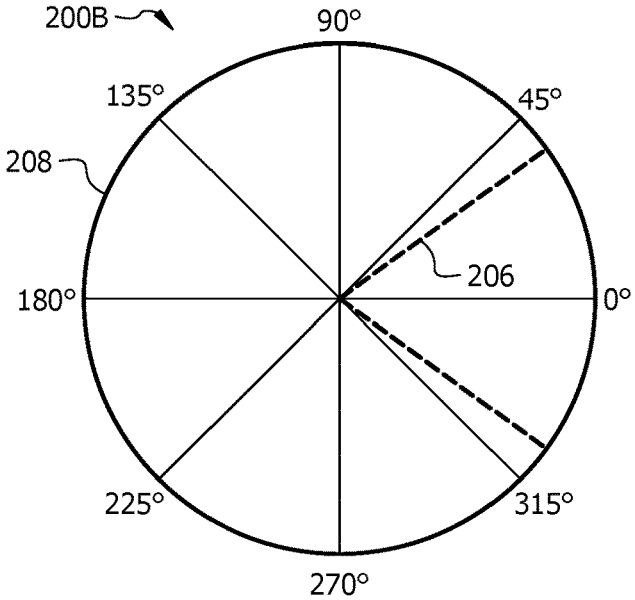
FIG. 2B represents an alternative representation of the channel borders using a polar plot, in accordance with embodiments of the present disclosure.

FIG. 2B represents alternative representation 200B of the channel borders using a polar plot, in accordance with embodiments of the present disclosure. The channel borders 206 may be identified using acoustic signals produced by an unipole transmitter/source and collected by an unipole receiver positioned at the same azimuth at an arbitrary axial distance. In polar plot 208, the transmitter and receiver may be simultaneously rotated azimuthally to perform the acoustic measurements at each increment $d\delta$, and an acoustic pulse is transmitted and received, for each angular increment, until a full rotation (360°) measurement path is completed.

In one example, one way to characterize the bond quality may be to use a known acoustic response from a fully bonded section and subtract it from all other measured data. This may imply that a standard signal signature or a comparative baseline representing good metal/cement adherence needs to be previously known. The obtained difference may be understood as discrepancies from the fully bonded scenario, or deviations from an ideal case, and thus a bond index can be estimated. However, a fully bonded reference signal may be difficult to achieve in practice since it depends on the geometry of the tubing strings, materials, transmitted acoustic pulse, etc.

Figure 3:
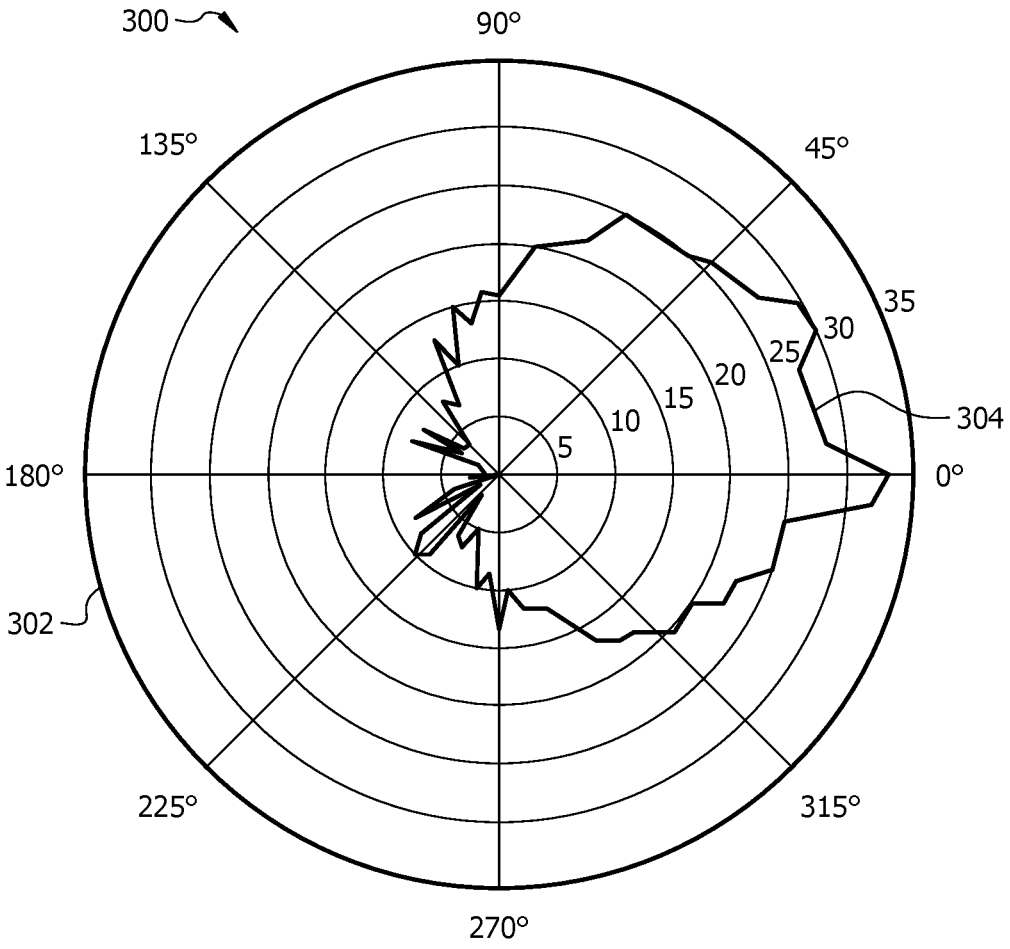
FIG. 3 illustrates results of a polar differential method applied to a data set, in accordance with embodiments of the present disclosure.

FIG. 3 illustrates results 300 of a polar differential method applied to a data set to determine material properties such as cement bonding, in accordance with embodiments of the present disclosure. In the polar differential method, a pair of acoustic measurements may be processed to determine a polar differential signal. For example, the polar differential signal may comprise a signal resulting from subtracting the amplitude of an acoustic measurement at a first azimuthal angle $\theta$ from the amplitude of an acoustic measurement at a second azimuthally offset angle $\theta+180°$. Therefore, the signals coming from the tubing and annulus between the tubing and the casing may be canceled out. The remaining acoustic signal may comprise relevant information about the cement behind the casing. As shown in polar plot 302, the channel position/direction 304 may be identified by comparing the polar differential signals with a modeled differential signal within a cement boundary echo window. The modeled differential signal may be generated from the difference between a bonded acoustic response model and a non-bonded or "free pipe" acoustic response model. The identified/selected reference azimuth may be utilized to generate a material condition index corresponding to the axial location along the borehole. In some embodiments, the polar differential method may include determining differences between the raw acoustic measurement collected at the reference azimuth and acoustic measurements collected at the other azimuths. A borehole material condition may be determined based, at least in part, on the determined differences.

Figure 4:
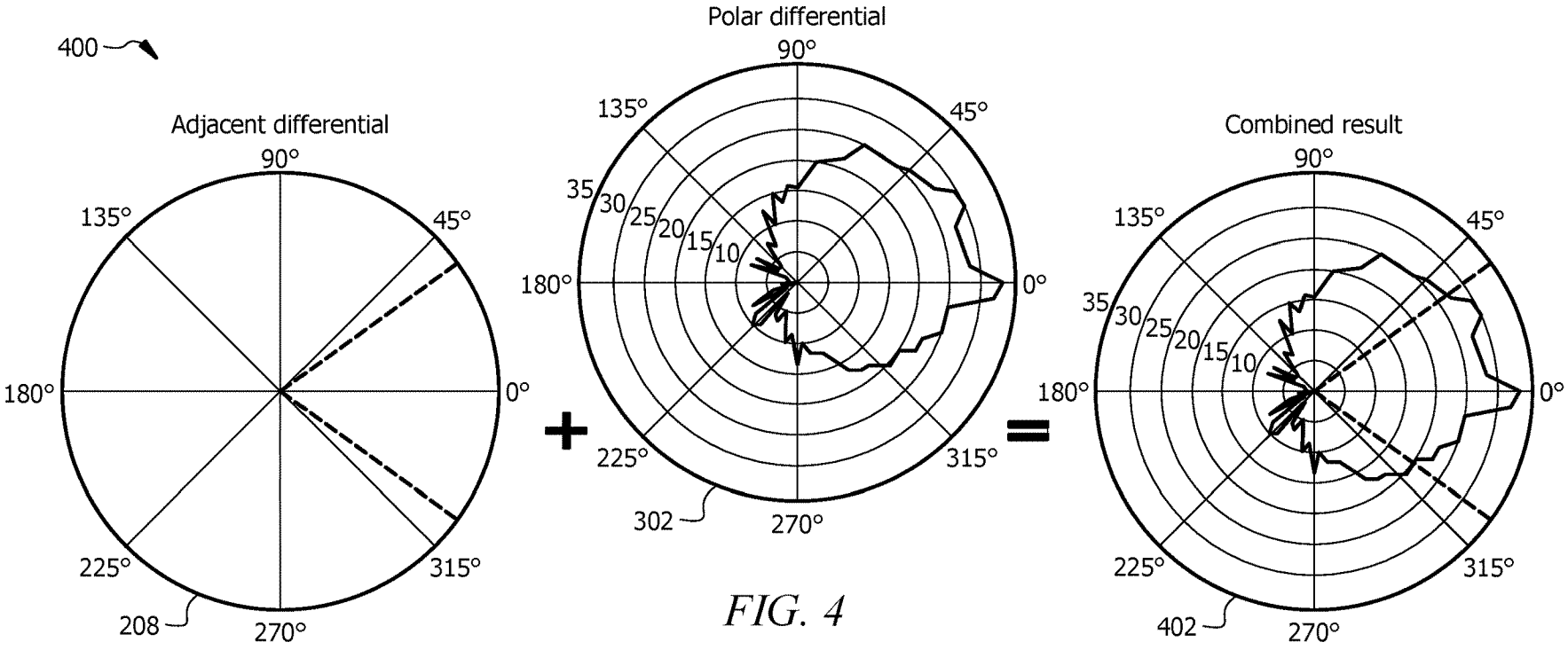
FIG. 4 illustrates an example of a combined approach between an adjacent differential method and a polar differential method, in accordance with embodiments of the present disclosure.

FIG. 4 illustrates an example of a combined approach 400 between the adjacent differential method and polar differential method, in accordance with embodiments of the present disclosure. Since the adjacent differential method only detect the channel borders, the polar differential method may complement the analysis and define the direction of the channel. In one implementation, measurements from the adjacent differential polar plot 208 and measurements from the polar differential polar plot 302 may be combined to produce a joint output 402 as shown in FIG. 4.

Figure 5:
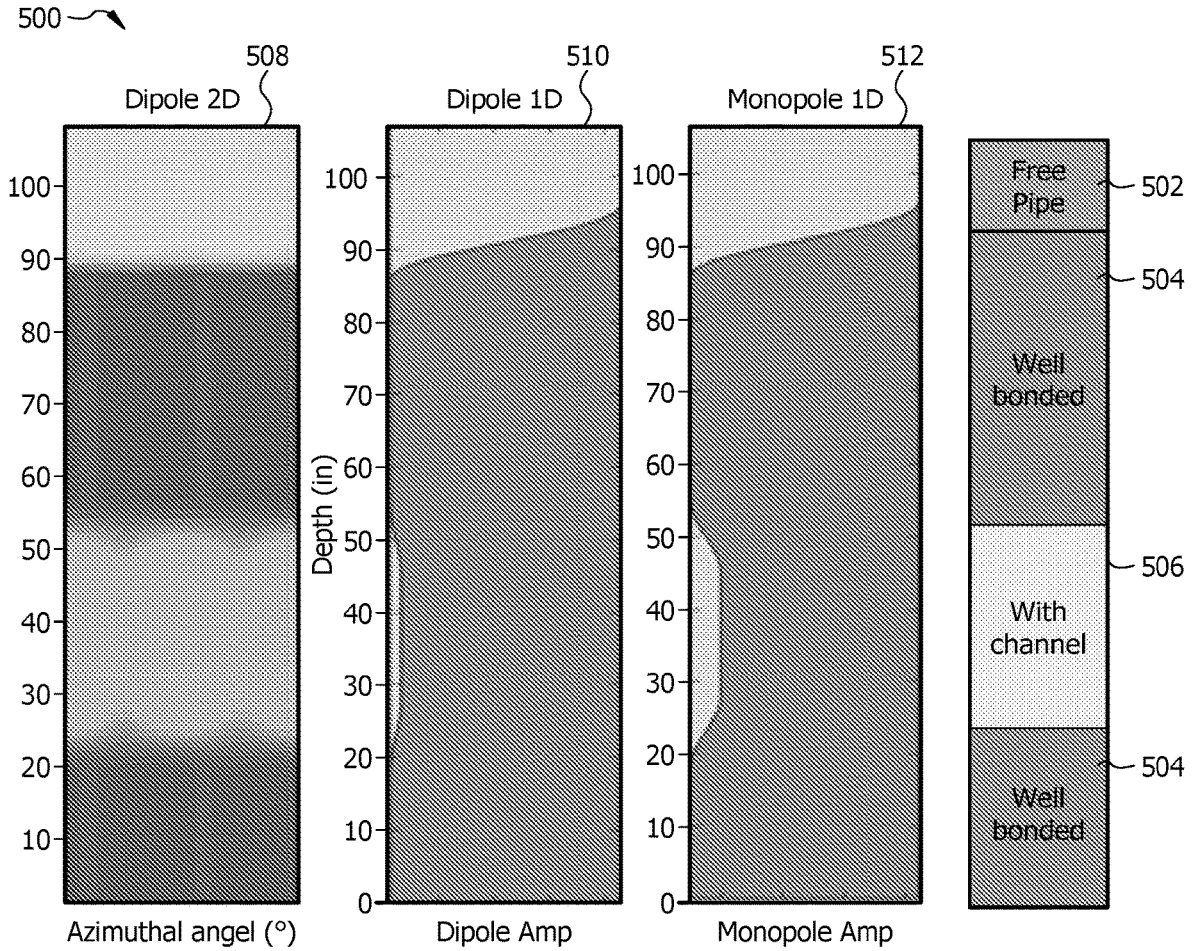
FIG. 5 illustrates a sample log of a resonance mode method for a well section with different cement bonding conditions, in accordance with embodiments of the present disclosure.

FIG. 5 illustrates a sample log 500 of a resonance mode method for a well section with different cement bonding conditions for dipole mode and monopole mode, in accordance with embodiments of the present disclosure. Through tubing cement evaluation has been developed using monopole excited borehole resonance. However, monopole mode may change with eccentricity and it may be difficult to isolate in time and frequency domain. Thus, the dipole resonance mode method may provide an alternative solution to complement the monopole result. As shown in FIG. 5, the different cement bonding conditions may include free pipe 502, well-bonded 504, and channel 506. The resonance mode may use the radial resonance modes of the borehole including the tubing, the casing, and the fluid in between. The amplitude or decay rate of the resonance signal may indicate the cement bonding condition of the casing. The resonance mode method may use the late time signal and transform the signal into a frequency domain. The peaks in the frequency domain may indicate the resonance modes of a borehole system. The casing-sensitive modes may be identified by their frequency responses or their mode shapes. The modes may also be identified as a dipole two-dimensional (2D) mode 508, a dipole one-dimensional (1D) mode 510, and a monopole one-dimensional (1D) mode 512, a quadrupole, or higher-order modes. The resonance mode may generally produce a 1D bonding index, wherein a value 0 of the bonding index may indicate free pipe, value 1 may indicate fully bonded casing, and the values in between 0 and 1 may indicate the degree of partial bonding (for example, channel size). Some higher-order multipoles may have direction sensitivity. For example, a dipole mode may detect a partial bonding with direction, wherein the direction has a 180° ambiguity. The dipole mode has a 180° ambiguity in channel direction showing the channel position at both 0° and 180°.

Figure 6:
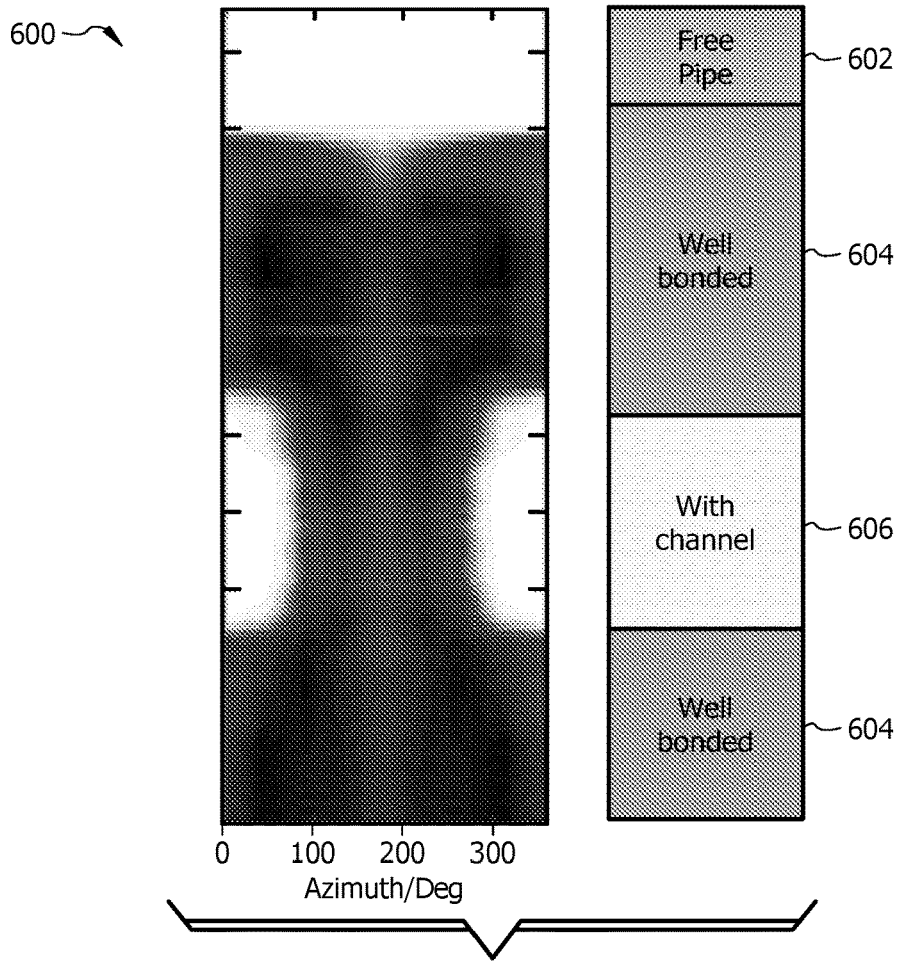
FIG. 6 illustrates a sample log of a casing guided wave method for a well section with different cement bonding conditions, in accordance with embodiments of the present disclosure.

FIG. 6 illustrates a sample log 600 of a guided wave method for a well section with different cement bonding conditions, in accordance with embodiments of the present disclosure. As discussed above, the different bonding conditions may include free pipe 602, well-bonded 604, and channel 606. In one example, guided waves may be excited and captured by unipole transmitters and unipole receivers, which are mounted on a rotation head of the acoustic logging tool 102. The guided waves may propagate in both the tubing 104 and the casing 106. The casing guided wave method may separate the casing guided waves from the tubing guided waves through azimuthal and frequency band-pass filters. The bonding condition behind the casing may be further extracted from the amplitude and attenuation of measured casing guided waves.

Figure 7A:
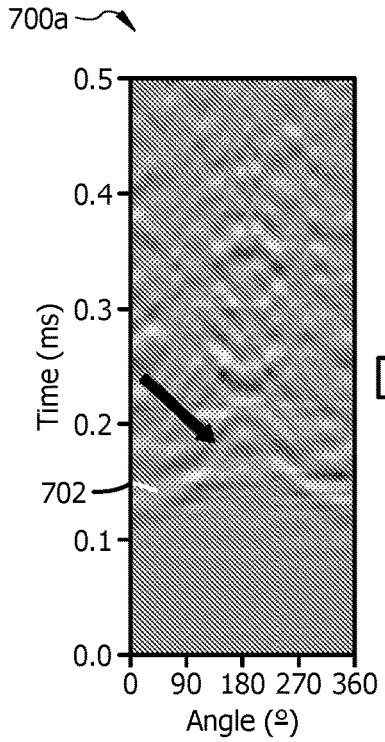
FIG. 7A illustrates results of a Third Interface Echo (TIE) processing method used for eccentricity evaluation, in accordance with embodiments of the present disclosure.

FIG. 7A illustrates results 700A of a Third Interface Echo (TIE) processing method used for eccentricity evaluation, in accordance with embodiments of the present disclosure. The severity of the eccentricity may affect the measurement of the acoustic methods discussed above. Hence, eccentricity evaluation may be necessary for a through tubing cement evaluation method. The results from the TIE processing method is showing the periodic pattern related to the casing arrival 702. This information may be used to estimate the direction (i.e., azimuth angle where the tubing is at the closest distance from the casing) and magnitude of the tubing eccentricity related to the casing, and also visualization of how eccentricity changes along the well depth. In particular, the direction of TIE signal may be used for eccentricity evaluation. The TIE signal may be obtained with a rotating tilted unipole acoustic transmitter and receiver. After removing the common tubing arrivals, the obtained TIE signal may be used to estimate the eccentricity and magnitude of eccentricity as well as the fluid velocities. Since the information provided by the TIE signal may also be related to the material behind the casing, it may be possible to extract cement bonding information in a through tubing evaluation.

Figure 7B:
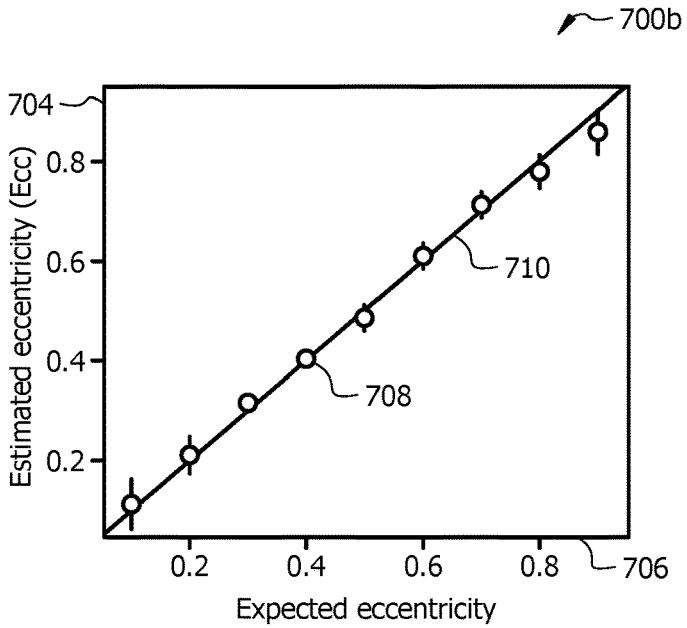
FIG. 7B represents a graph comparing the values of estimated eccentricities and nominal values, in accordance with embodiments of the present disclosure.

FIG. 7B represents a graph 700B comparing the values of estimated eccentricities 704 and nominal values 706 (i.e. expected eccentricity). Each dot 708 may represents one estimation from 10% to 90% eccentricity. The small dispersions on each dots may be related to the precision in obtaining the parameters for the estimation. The diagonal linear line 710 may be a guide to where the dots 708 lie in a perfect match scenario between the estimated eccentricity values 704 and the expected eccentricity values 706.

Figure 7C:
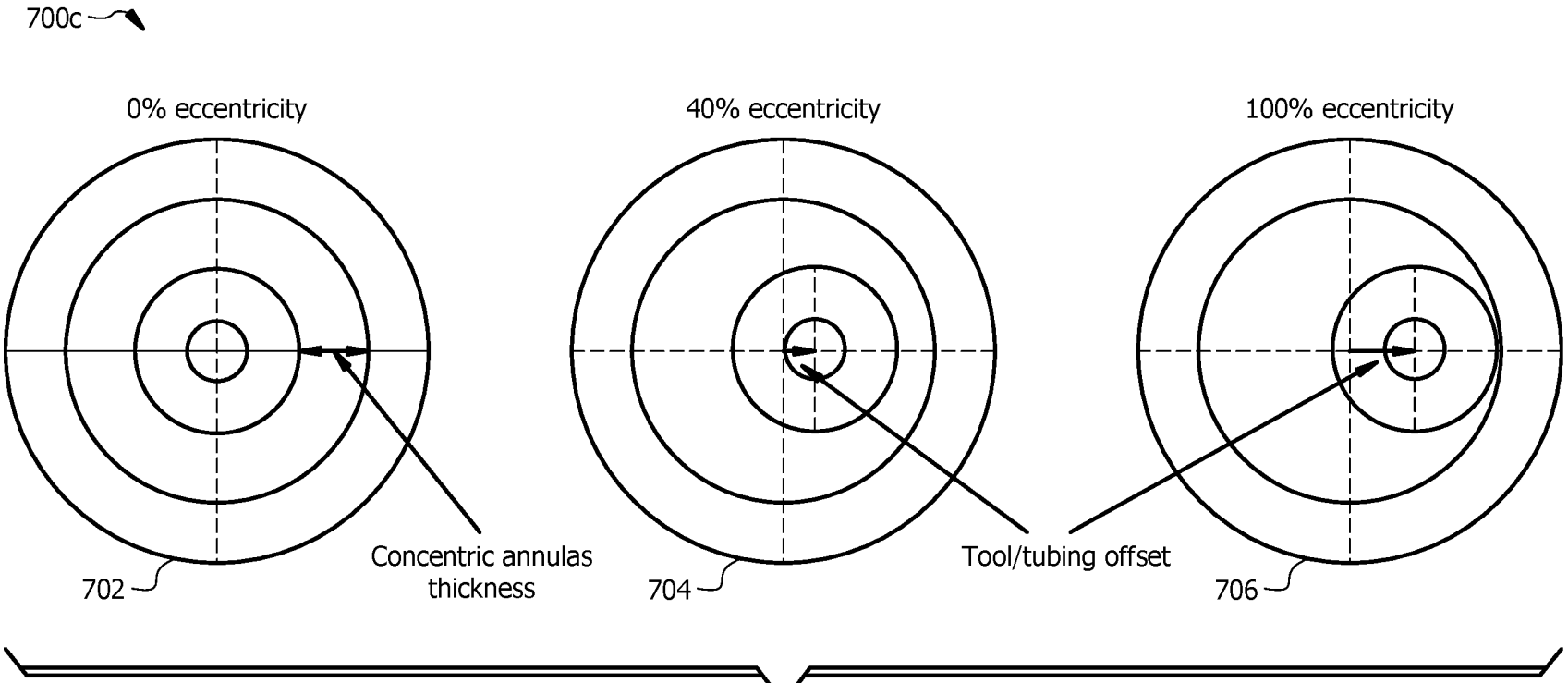
FIG. 7C illustrates a graphical view of evaluation of the eccentricity of the tubing within a borehole environment, in accordance with embodiments of the present disclosure.

FIG. 7C represents a diagrammatic view 700C of detection of the eccentricity of the tubing within the borehole, in accordance with embodiments of the present disclosure. In some embodiments, as the tubing is decentralized and moves from a centralized position towards the channel, the channel may appear azimuthally wider inside the tubing, and conversely as the tubing is moving from a centralized position away from the channel, the channel may appear narrower. The eccentricity evaluation method may also be used to correct such effects. As can be seen from the FIG. 7C, the various eccentricity configurations (702, 704, and 706) may be evaluated as the offset of the tubing 104 from casing center divided by the centered annulus thickness between the tubing 104 and the casing 106. The eccentricity configuration 702 with the eccentricity value of 0% indicates that the tubing 104 may be centered in the casing 106, the eccentricity configuration 704 with eccentricity value of 40% indicates that the tubing 104 is near to the casing 106, and the eccentricity configuration 706 with eccentricity value of 100% indicates that the tubing 104 is touching the wall of the casing 106.

As described above, the various acoustic methods may have varying performance in various aspects, such as azimuthal or vertical resolution, border detection, eccentricity robustness, etc. Furthermore, the acoustic methods may offer separate logs measuring the same physical property. However, reading multiple logs may be challenging for a user especially one without knowledge of the principle of each acoustic method. The challenges may be addressed by combining the results of different acoustic measurements on the same physical property from various acoustic methods to produce an optimized log that removes ambiguity and provides a joint interpretation of the acoustic measurements. When combining the various acoustic methods, their output may not be considered equal, but output may be considered based on their confidence level of a particular bonding condition.

In some embodiments, the disclosed methods and systems may determine a QC value associated with each method to indicate the confidence level of predicting the correct bonding condition. Because the QC value is method/case dependent, it may be considered as a multi-dimensional matrix based on the parameters of the cement bonding condition and configurations.

Figure 8:
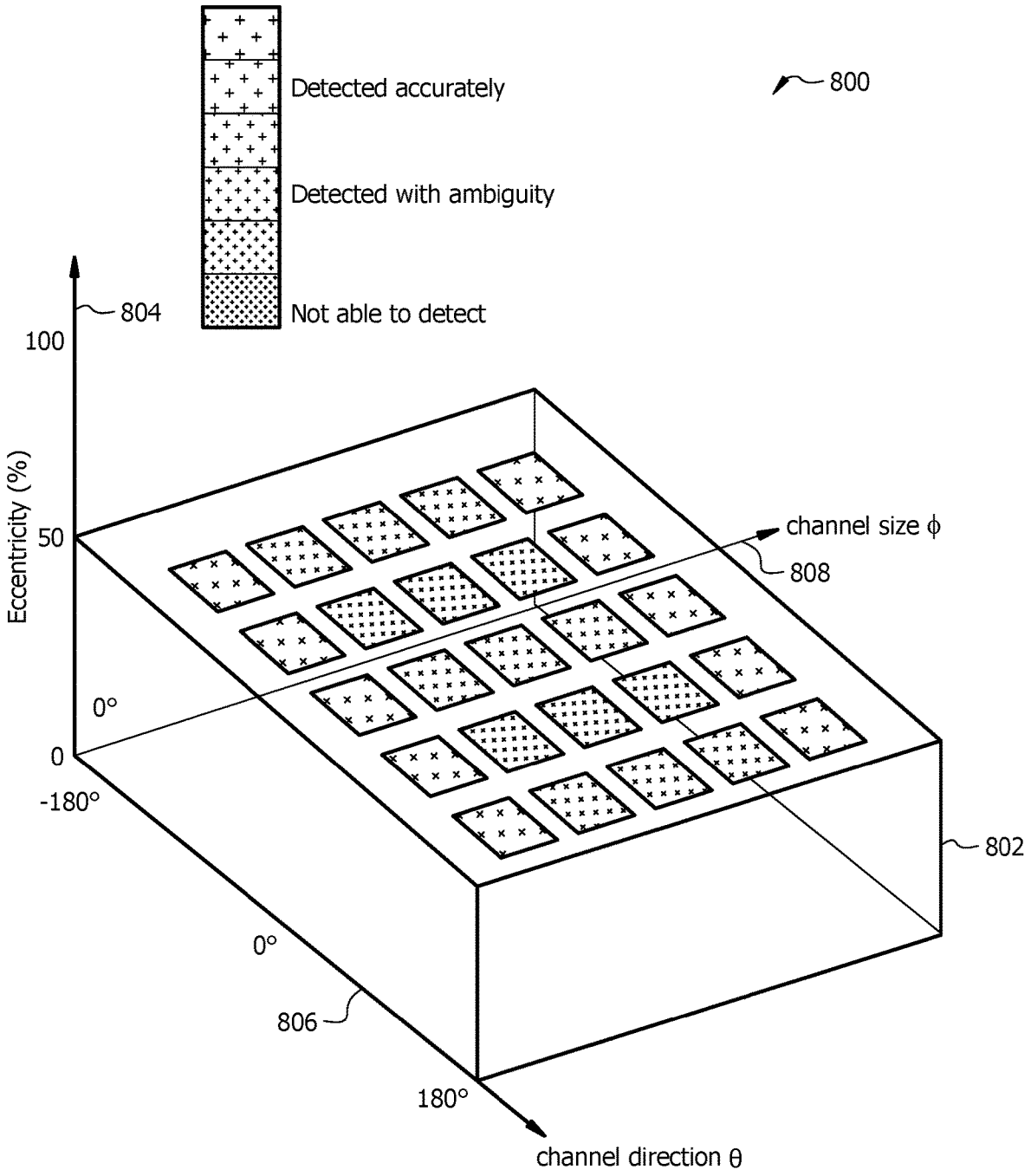
FIG. 8 illustrates an example of a discretized representation of quality control (QC) value in a matrix for various cement bonding parameters, in accordance with embodiments of the present disclosure.

FIG. 8 illustrates an example of a discretized representation 800 of QC values in a multi-dimensional matrix 802 for various parameters for an acoustic method, in accordance with embodiments of the present disclosure. In some embodiments, the acoustic method may include an adjacent differential method, a polar differential method, a borehole resonance method, a casing guided waves method, or any other acoustic method. In one example, the parameters may include tubing and casing configuration, eccentricity, channel direction, channel size, channel thickness, material property, etc. These parameters may be evaluated for calculating QC values for a specific acoustic method at a specific/given depth of the tubing 104 in the borehole. In some embodiments, the QC value associated with each acoustic method may indicate a confidence level of predicting the correct bonding condition. The calculated QC values may be represented in the matrix form 802.

For the purposes of illustration, FIG. 8 shows an example of the QC value for the dipole resonance method. As discussed above, through simulation and experimental analysis, the dipole resonance method has proven to be effective in identifying well bonded and free pipe conditions at various eccentricities. Hence, the column in the QC matrix corresponding to 0° and 360° channel sizes are given a high value (high confidence level). For cases with partial bonding, the method may be more effective when the channel is located along the eccentricity direction. Hence, the rows of QC values corresponding to channel direction θ at 0° or 180° are given a medium value. The rest of the QC values are given a low value. For example, 1) the QC value of eccentricity (i.e., tool/tubing offset towards 0° divided by centered annulus thickness) may be represented towards the positive Z-axis 804 of the matrix 802. The range of eccentricity may vary from 0% to 100%. 2) The QC value of channel direction θ (i.e., an angle between channel center and eccentricity direction varying from −180° to 180°) may be represented towards X-axis 806 of the matrix 802. The channel direction may change with respect to eccentricity direction. 3) The QC value of channel size φ (i.e., an angle between two borders of the channel varying from 0 to 360°) may be represented towards the positive Y-axis 808 of the matrix 802. The tubing and casing configuration parameter may comprise tubing outer diameter, tubing thickness, casing outer diameter, casing thickness.

Because the QC value is case-dependent, it may be considered as a multi-dimensional matrix based on the parameter of the bonding condition and configurations. Since the QC values may change with some or all of the parameters discussed above, the QC value may be discretized according to the parameter. In one example, one way of expressing the QC values is in the matrix form as shown in FIG. 8. The QC value matrix 802 may be generated for a specific method, tubing/casing configurations, and/or material property. The QC value may be predicted by simulation data, experimental data, or field data. The QC value may also be represented with multi-dimensional equations or a combination of equation and matrix with certain continuous dimensions and certain discretized dimensions.

Figure 9:
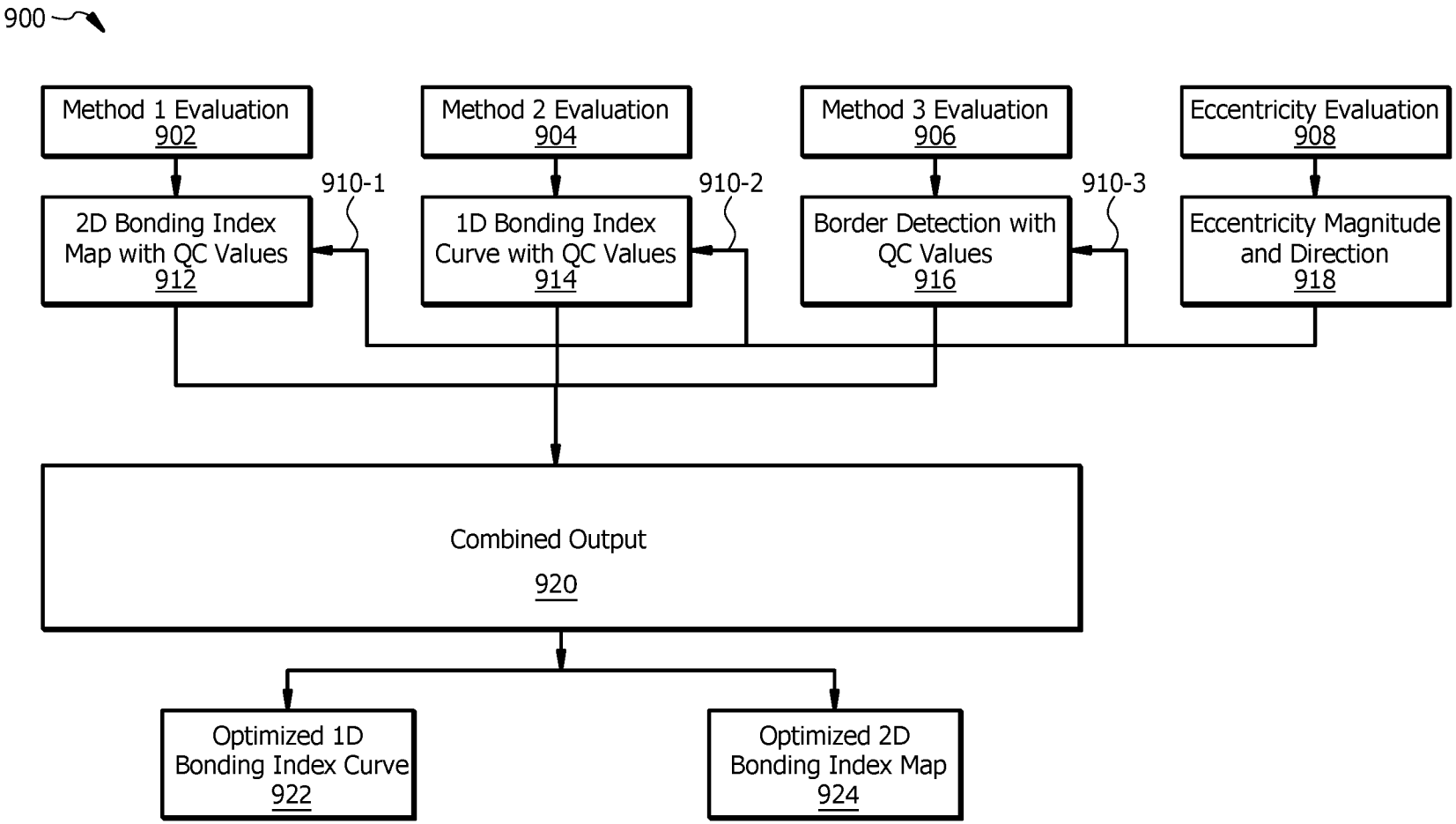
FIG. 9 illustrates a workflow of a combined method to obtain an optimized cement bonding index log, in accordance with embodiments of the present disclosure.

FIG. 9 illustrates a workflow 900 of a combined method to obtain an optimized cement bonding index log, in accordance with embodiments of the present disclosure. The example method may be performed by hardware, software, firmware, or a combination thereof. For example, at least some of the operations may be performed by a processor executing program code or instructions. In some embodiments, such methods may be performed in a computer at the surface. The generalized workflow 900 may provide a combined method that combines bonding condition results from multiple acoustic methods discussed above. Under this combined analysis, the acoustic methods may be evaluated for determining acoustic cement bond evaluation data associated with each method, and then methods may be combined to obtain an optimized cement bonding index log. The individual stages or elements of workflow 900 are explained in detail below. The acoustic cement bond evaluation data may be evaluated via various processing tools such as a computer-based system having one or more processors in which the acoustic waveform data is processed and then the results regarding cement bond quality are output to an appropriate output device, e.g. a computer at a surface of the borehole.

As shown in FIG. 9, at block 902, a first acoustic method may be evaluated. The first acoustic method may comprise a casing guided wave method. At block 912, the results of evaluating the acoustic measurements from the first acoustic method may generate a 2D bonding index map with corresponding QC value. At block 904, a second acoustic method may be evaluated. The second acoustic method may comprise a resonance method. At block 914, the results of evaluating the acoustic measurements from the second method may generate a 1D bonding index map with corresponding QC value. At block 906, a third acoustic method may be evaluated. The third acoustic method may comprise an adjacent differential method. At block 916, the results of evaluating the measurements from the third method may generate channel border detection values with corresponding QC value. In some embodiments, the QC value associated with each acoustic method may provide a confidence level of predicting the correct cement bonding condition. Furthermore, the eccentricity of the tubing from the casing center may affect the measurements of the acoustic methods. Hence, at block 908, the eccentricity of the tubing 106 relative to the casing 104 in the borehole may be evaluated. The output of the eccentricity evaluation may provide the direction (i.e., azimuth angle where the tubing is at the closest distance from the casing) and magnitude of the eccentricity. The eccentricity evaluation output at block 918 may serve as an input 910-1, 910-2, and 910-3 to the acoustic methods at blocks 912, 914, and 916 respectively. At block 920, the output of all the acoustic methods considering the QC values may be combined using a physics-based empirical equation/formula. The combined output may be displayed as an optimized cement evaluation index log. The optimized cement bonding evaluation log may be displayed on a computer at the surface or other suitable output device as an optimized 1D bonding index curve 922 or an optimized 2D bonding index map 924. In one example, the optimized cement evaluation index log may display the optimized 1D bonding index curve 922 or the optimized 2D bonding index map 924 indicating overall cement bonding condition such as channel size or channel direction.

The disclosed combined method may generate the physics-based empirical equation in various ways. In some embodiments, a weighted summation may be employed to analyze the results of the combined output. The bond index (BI) value associated with each method (e.g., 902, 904, and 906) may be taken as a value of the weight and the combined value/weighted summation may be determined on a weighted average value of each of the BI values of each of the acoustic methods.

In some embodiments, the empirical formula may be calculated by comparing QC values of at least two acoustic methods, altering a weight of the QC value depending on the match between the two methods based on the comparison, and using an optimized weight in the weighted summation In some embodiments, a machine learning model may be employed to analyze the combined output to generate the optimized cement bonding index log. In this case, simulation data, experimental data, or field data may be used to train and validate the empirical equation. In some embodiments, for the machine learning approach, features engineering may be performed using combinations and transformations of domain knowledge variables. Furthermore, automated algorithms such as Deep Feature Synthesis and Multi-relational decision tree learning (MRDTL) may be applied. The acoustic measurements for various acoustic methods may be processed using a processor and, in examples, in conjunction with the machine learning model. There are many different types of machine learning models comprise supervised learning models or unsupervised learning models. For example, machine learning may be any form of neural network (NN), Convolutional Neural Network (CNN), Recurrent Neural Network (RNN), Deep Learning Neural Network (DNN), random forest network, AI training, pattern recognition, Support Vector Machine (SVM), gradient boosting, clustering and principal component analysis (PCA) and/or the like. It should be noted that this is only an example, and many other forms of machine learning may be utilized.

The disclosed combined method may save the time and resources of the users by eliminating the requirement for separate cement evaluation logs for each acoustic method and providing combined information about the cement bonding conditions. Example methods and systems disclosed may also help in improving the final product quality by applying quality control filters, removing ambiguity, and aiding untrained users in log quality control.

Figure 10:
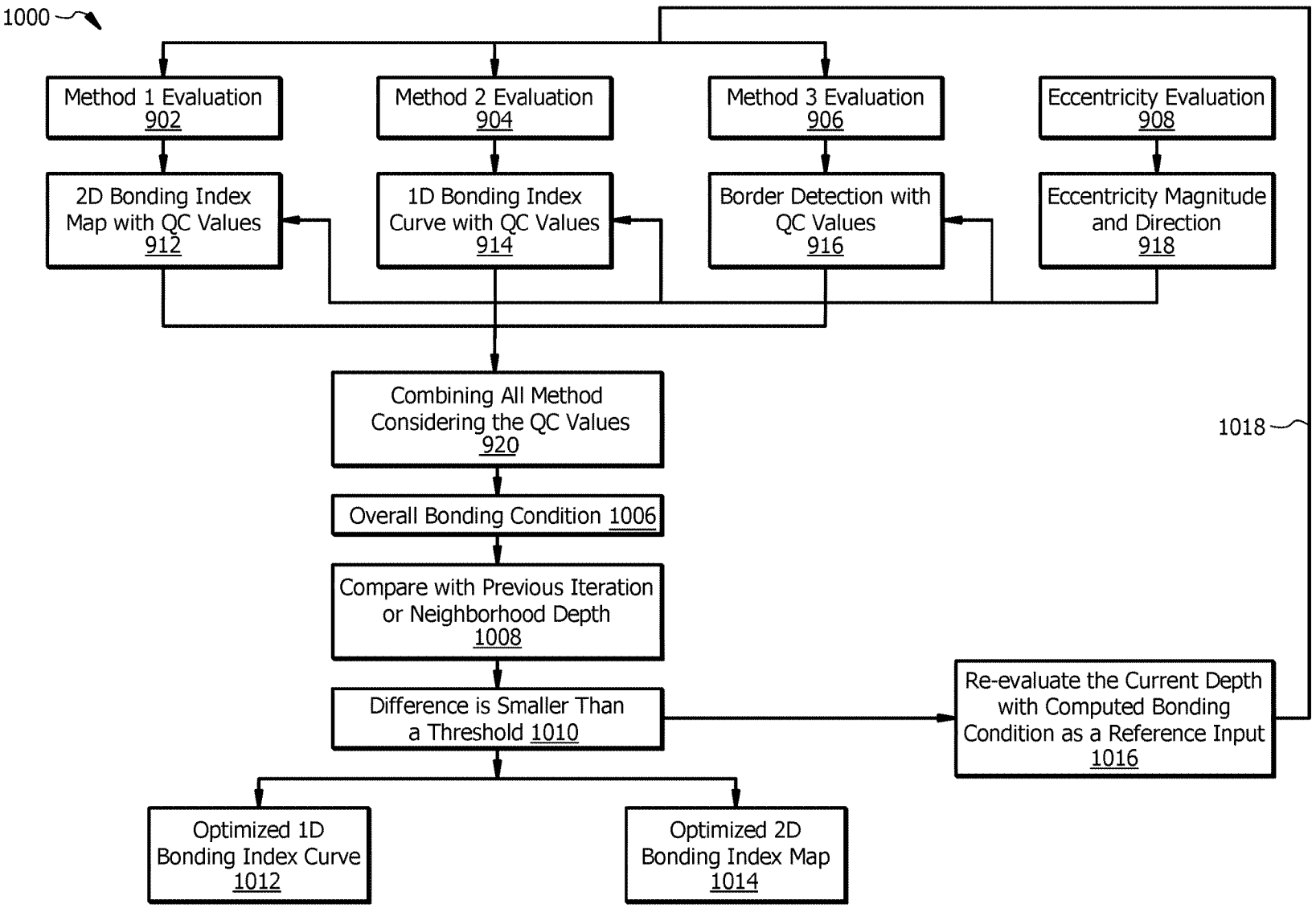
FIG. 10 illustrates a workflow of an iterative approach of processing multiple methods with QC values, in accordance with embodiments of the present disclosure.

FIG. 10 illustrates workflow 1000 of an iterative approach of processing multiple methods with QC value, in accordance with embodiments of the present disclosure. As discussed above in FIG. 9, at block 920, the output of multiple methods and their QC values may be computed via the empirical formula to produce an optimized cement evaluation index log. At block 1006, the optimized cement evaluation index log may display a curve/map indicating the overall cement bonding condition. At block 1008, a comparison between the overall bonding condition and a reference value may be computed. In one example, the reference value may be the value of the bonding condition obtained from the previous iteration or neighborhood depth. Based on the comparison, at block 1010, a determination whether a difference between a value of the calculated overall bonding condition and the reference value is smaller than a threshold may be made. The evaluation of the acoustic measurements for various methods at the next depth of the wellbore may be done when the threshold is small. This implies that the overall bonding condition converges to a stable value and the processing moves to the one of the block 1012, 1014 to display an optimized bonding index curve/map for the current depth. Otherwise, at block 1016, reevaluation of the current depth of the tubing may be done using the computed overall bonding condition as a new reference input 1018 for each method to re-process when the threshold is large. It implies that the predicted bonding condition may be used as the input to re-evaluate the bonding condition for each method.

Figure 11:
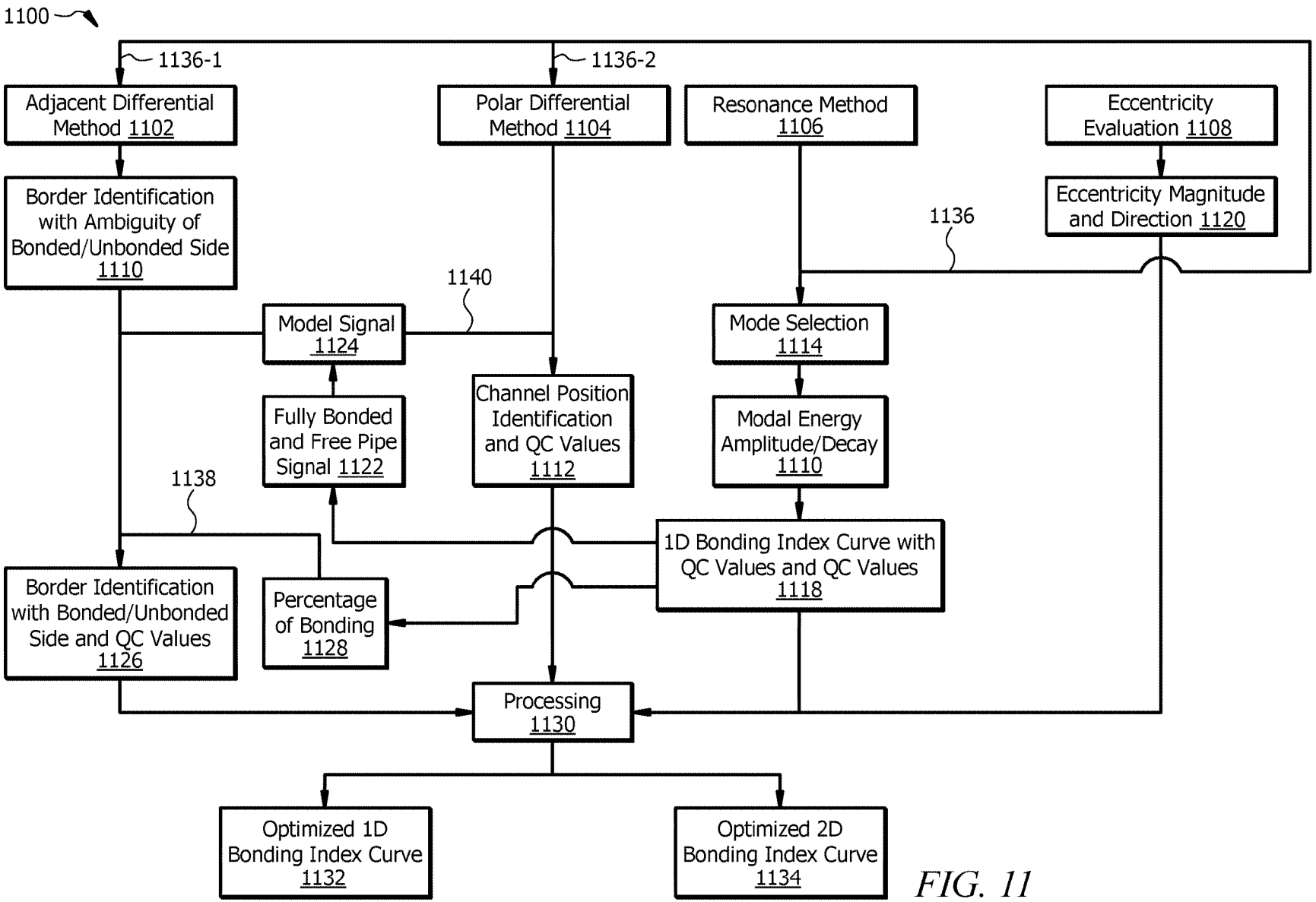
FIG. 11 illustrates a workflow for combining multiple acoustic methods to obtain an optimized cement bonding index log, in accordance with embodiments of the present disclosure.

FIG. 11 illustrates a workflow 1100 for combining multiple acoustic methods to obtain an optimized cement bonding index log, in accordance with embodiments of the present disclosure. In some embodiments, during the processing, a result from one acoustic method may be used as an input to another acoustic method to significantly improve the result of the other acoustic method. As indicated in FIG. 11, the adjacent differential method 1102, the polar differential method 1104, and resonance method 1106 may be combined in a physics-based manner. As discussed above in FIG. 2A, the adjacent differential method 1102 may determine the channel borders 206, but cannot identify which side of the channel is bonded. Thus, the adjacent differential method may provide an output 1110 that detects border identification with the ambiguity of bonded/unbonded side. To rectify and to improve the output 1110 of the adjacent differential method, the resonance method 1106 may provide a percentage of bonding 1128, which may help the adjacent differential method final output 1126 to identify the borders with a side of bonding (except at about 50% bonding) and associated QC values. In a similar case, the polar differential method 1104 may determine the channel position/direction 304 as discussed in FIG. 3, but cannot differentiate between a fully bonded condition and a free pipe condition. The resonance method 1106 may provide the information regarding fully bonded and free pipe signal 1122 to compensate for the deficiency of polar differential method 1104. Furthermore, the polar differential method 1104 may require a baseline signal or a model signal from a free pipe and fully bonded condition. These signals may be obtained from modeling data, experimental data, or field data. The resonance method may identify sections with free pipe and fully bonded condition, which can be used as the model signal 1124 for the polar differential method 1104. By using the inputs (1122, 1124) from the resonance mode method, the productivity/output 1112 of the polar differential method may be increased. Furthermore, the eccentricity of the tubing from the casing center may affect the measurement of the acoustic methods (1102, 1104, and 1106). Hence, eccentricity evaluation 1108 may be necessary for accurate acoustic measurements of each method. The eccentricity evaluation data 1108 may provide the direction (i.e., azimuth angle where the tubing is at the closest distance from the casing) and magnitude of eccentricity 1120. The direction and magnitude of eccentricity 1120 may serve as an input 1136 to the resonance method 1106, which may further serve as a first input 1138 to the adjacent differential method 1102 and a second input 1140 to the polar differential method. The direction and magnitude of eccentricity 1120 may also serve as an input 1136-1 to the adjacent differential method and an input 1136-2 to the polar differential method to adjust for eccentricity. Then, the output 1126, 1128, 1118, and 1120 from all the methods (1102, 1104, 1106, and 1108) may be combined and processed 1130 using a physics-based empirical equation/formula to generate an optimized cement evaluation index log. The optimized cement bonding evaluation log may be displayed on a computer at the surface or other suitable output device as an optimized 1D bonding index curve 1132 or an optimized 2D bonding index map 1134. In one example, the optimized cement evaluation index log may display a curve/map indicating the overall cement bonding condition.

Thus, the overall cement bonding condition determined using the above discussed combined methods and systems for the through tubing cement evaluation application may save the time, cost, and resources of the users. Example methods and systems disclosed may also help in improving the final product quality by applying quality control filters, removing ambiguity, and aiding untrained users in log quality control. Furthermore, the combined information about the cement bonding condition may determine the quality of the cementing operation, the necessity for repairs, or an improvement for future wells to make critical downhole choices with confidence.

Additional Disclosure

The following are non-limiting, specific embodiments in accordance with the present disclosure:

A first embodiment, which is a method of through tubing cement evaluation, comprising obtaining acoustic cement bond evaluation data relating to a property of a cement bond of a cased-borehole for each of a plurality of acoustic methods, wherein the acoustic cement bond evaluation data comprises a quality control (QC) value indicative of a confidence level of cement bonding condition, determining an eccentricity value of a tubing relative to a casing in the borehole, determining an output of each acoustic method by combining the eccentricity value and the acoustic cement bond evaluation data associated with each acoustic method, combining the output of each acoustic method to generate an optimized cement bonding index log of the cement bond, and employing the optimized cement bonding index log to provide an interpretation of an overall cement bonding condition.

A second embodiment, which is the method of the first embodiment, wherein the acoustic methods comprise an adjacent differential method, a polar differential method, a resonance-based method, or a casing guided wave based method.

A third embodiment, which is the method of any of the first and the second embodiments, wherein the cement bonding condition is characterized based on a bond index (BI) value and/or a bond index two-dimensional (2D) map, wherein the BI value 1 represents that the tubing is bound to cement, and wherein the BI value 0 represents that the tubing is free of bonding to the cement.

A fourth embodiment, which is the method of any of the first through the third embodiments, wherein the method further comprising combining the output of each acoustic method using an empirical formula to generate the optimized cement bonding index log.

A fifth embodiment, which is the method of any of the first through the fourth embodiments, wherein the empirical formula is calculated by performing a weighted summation of weighted BI values of each acoustic method.

A sixth embodiment, which is the method of any of the first through the fifth embodiments, wherein the empirical formula is calculated by comparing QC values of at least two acoustic methods, altering a weight of the QC value based on the comparison, and using an optimized weight in the weighted summation.

A seventh embodiment, which is the method of any of the first through the sixth embodiments, wherein the method further comprising combining the output of each acoustic method employing a machine learning system to generate the optimized cement bonding index log.

An eighth embodiment, which is the method of any of the first through the seventh embodiments, wherein the machine learning system implements supervised learning or unsupervised learning.

A ninth embodiment, which is the method of any of the first through the eighth embodiments, wherein the supervised learning comprises random forests, gradient boosting, or support vector machines (SVM).

A tenth embodiment, which is the method of any of the first through the ninth embodiments, wherein the unsupervised learning comprises clustering and principal component analysis (PCA).

An eleventh embodiment, which is the method of any of the first through the tenth embodiments, wherein the cement bonding condition depends on a plurality of cement bonding parameters, a configuration of the tubing, a configuration of the casing, a property of material behind the casing, a channel size, a channel direction, and/or a channel thickness.

A twelfth embodiment, which is the method of any of the first through the eleventh embodiments, wherein the configuration of the tubing comprises tubing outer diameter or tubing thickness, and wherein the configuration of the casing comprises casing outer diameter or casing thickness.

A thirteenth embodiment, which is the method of any of the first through the twelfth embodiments, wherein the method further comprises determining whether a difference between the overall cement bonding condition and a previously determined cement bonding condition is greater than a threshold, and in response to the determination, using the overall cement bonding condition as a reference input to each acoustic method to reevaluate the cement bonding condition.

A fourteenth embodiment, which is the method of any of the first through the thirteenth embodiments, wherein an output of a first acoustic method is used as an input of a second acoustic method.

A fifteenth embodiment, which is the method of any of the first through the fourteenth embodiments, wherein the eccentricity value provides a direction and a magnitude of the tubing eccentricity relative to the casing.

A sixteenth embodiment, which is the method of any of the first through the fifteenth embodiments, wherein the eccentricity value varies between 0% to 100%, wherein the eccentricity value 0% indicates that the tubing is centered in the casing, and wherein the eccentricity value 100% indicates that the tubing is touching the wall of the casing.

A seventeenth embodiment, which is the method of any of the first through the sixteenth embodiments, wherein the QC value is represented by multi-dimensional equations, a combination of the multi-dimensional equations and a matrix, or a discretized representation.

An eighteenth embodiment, which is the method of any of the first through the seventeenth embodiments, wherein the QC value is predicted by simulation data, experimental data, or field data.

A nineteenth embodiment, which is a system, comprising a processor and a computer-readable medium having instructions stored thereon that are executable by the processor to cause the system to obtain acoustic cement bond evaluation data relating to a property of a cement bond of a cased-borehole for each of a plurality of acoustic methods, wherein the acoustic cement bond evaluation data comprises a quality control (QC) value indicative of a confidence level of cement bonding conditions, determine an eccentricity value of a tubing relative to a casing in a borehole, determine an output of each acoustic method by combining the eccentricity value and the acoustic cement bond evaluation data associated with each acoustic method, combine the output of each acoustic method to generate an optimized cement bonding index log, and employ the optimized cement bonding index log to provide an interpretation of an overall cement bonding condition.

A twentieth embodiment, which is the system of the nineteenth embodiment, wherein the acoustic methods comprise an adjacent differential method, a polar differential method, a resonance-based method, or a casing guided wave based method.

A twenty-first embodiment, which is the system of any of the nineteenth or twentieth embodiments, wherein the cement bonding conditions are characterized based on a bond index (BI) value and/or a bond index two-dimensional (2D) map, wherein the BI value 1 representing the tubing is bound to cement, and wherein the BI value 0 represents the tubing is free of bonding to the cement.

A twenty-second embodiment, which is the system of any of the nineteenth through the twenty-first embodiments, wherein the instructions stored thereon that are executable by the processor to further cause the system to combine the output of each acoustic method using an empirical formula to generate the optimized cement bonding index log.

A twenty-third embodiment, which is the system of any of the nineteenth through the twenty-second embodiments, wherein the empirical formula is calculated by performing a weighted summation of weighted BI values of each acoustic method.

A twenty-fourth embodiment, which is the system of any of the nineteenth through the twenty-third embodiment, wherein the empirical formula is calculated by comparing QC values of at least two acoustic methods, altering a weight of the QC value based on the comparison, and using an optimized weight in the weighted summation.

A twenty-fifth embodiment, which is the system of any of the nineteenth through the twenty-fourth embodiments, wherein the instructions stored thereon that are executable by the processor to further cause the system to combine the output of each acoustic method employing a machine learning system to generate the optimized cement bonding index log.

A twenty-sixth embodiment, which is the system of any of the nineteenth through the twenty-fifth embodiments, wherein the machine learning system implements supervised learning or unsupervised learning.

A twenty-seventh embodiment, which is the system of any of the nineteenth through the twenty-sixth embodiments, wherein the supervised learning comprises random forests, gradient boosting, or support vector machines (SVM).

A twenty-eighth embodiment, which is the system of any of the nineteenth through the twenty-seventh embodiments, wherein the unsupervised learning comprises clustering and principal component analysis (PCA).

A twenty-ninth embodiment, which is the system of any of the nineteenth through the twenty-eighth embodiments, wherein the cement bonding conditions depend on a plurality of cement bonding parameters, a configuration of the tubing, a configuration of the casing, a property of material behind the casing, a channel size, a channel direction, and/or a channel thickness.

A thirtieth embodiment, which is the system of any of the nineteenth through the twenty-ninth embodiments, wherein the configuration of the tubing comprises tubing outer diameter or tubing thickness, and wherein the configuration of the casing comprises casing outer diameter or casing thickness.

A thirty-one embodiment, which is the system any of the nineteenth through the thirtieth embodiments, wherein the processor further causes the system to determine whether a difference between the overall cement bonding condition and a previously determined bonding condition is greater than a threshold and in response to the determination, use the overall cement bonding condition as a reference input to each acoustic method to reevaluate the cement bonding conditions.

A thirty-second embodiment, which is the system any of the nineteenth through the thirty-one embodiments, wherein an output of a first acoustic method is used as an input of a second acoustic method.

A thirty-third embodiment, which is the system any of the nineteenth through the thirty-second embodiments, wherein eccentricity value provides a direction and a magnitude of the tubing eccentricity relative to the casing.

A thirty-fourth embodiment, which is the system any of the nineteenth through the thirty-third embodiments, wherein the eccentricity value varies between 0% to 100%, wherein the eccentricity value 0% indicates that the tubing is centered in the casing, and wherein the eccentricity value 100% indicates that the tubing is touching a wall of the casing.

A thirty-fifth embodiment, which is the system any of the nineteenth through the thirty-fourth embodiments, wherein the QC value is represented by multi-dimensional equations, a combination of multi-dimensional equations and matrix, or a discretized representation.

A thirty-sixth embodiment, which is the system any of the nineteenth through the thirty-fifth embodiments, wherein the QC value is predicted by simulation data, experimental data, or field data.

A thirty-seventh embodiment, which is a well measurement system, comprising an acoustic logging tool deployed in a cased-borehole in which a production tubing is installed within cement and casing, wherein the acoustic logging tool comprises at least one transmitter configured to broadcast acoustic wave signals such that the acoustic wave signals interact with the borehole, and at least one receiver configured to receive the acoustic wave signals, and an information handling system configured to obtain acoustic cement bond evaluation data relating to a property of a cement bond for each of a plurality of acoustic methods by processing the received acoustic wave signals, wherein the acoustic cement bond evaluation data comprises a quality control (QC) value indicative of a confidence level of cement bonding conditions, determine an eccentricity value of the production tubing relative to the casing in the borehole, determine an output of each acoustic method by combining the eccentricity value and the acoustic cement bond evaluation data associated with each acoustic method, combine the output of each acoustic method to generate an optimized cement bonding index log, and employ the optimized cement bonding index log to provide an interpretation of an overall cement bonding condition.

A thirty-eighth embodiment, which is the well measurement system of the thirty-seventh embodiment, wherein the transmitter is a monopole, a dipole, a quadrupole, a higher azimuthal order source, or a source with an asymmetrical radiation pattern.

A thirty-ninth embodiment, which is the well measurement system of any one of the thirty-seventh or thirty-eighth embodiment, wherein the information handling system comprises a processor at a surface of the borehole.

A fortieth embodiment, which is the well measurement system of any of the thirty-seventh through the thirty-ninth embodiments, wherein the acoustic wave signals are transmitted and received at one or more depths with the borehole.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method of through tubing cement evaluation, comprising:

deploying an acoustic logging tool within a tubing located inside a casing in a cased-borehole;

broadcasting, by a transmitter of the acoustic logging tool, acoustic wave signals such that the acoustic wave signals interact with the cased-borehole;

receiving, by a receiver of the acoustic logging tool, the acoustic wave signals;

obtaining acoustic cement bond evaluation data relating to a property of a cement bond of the cased-borehole for each of a plurality of acoustic methods by processing the received acoustic wave signals, wherein the acoustic cement bond evaluation data comprises a quality control (QC) value indicative of a confidence level of cement bonding condition;

determining an eccentricity value of the tubing relative to the casing, wherein the eccentricity value provides a direction and a magnitude of the tubing relative to the casing, wherein the eccentricity value varies between 0% to 100%, wherein the eccentricity value 0% indicates that the tubing is centered in the casing, and wherein the eccentricity value 100% indicates that the tubing is touching a wall of the casing;

determining an output of each of the acoustic methods by combining the eccentricity value and the acoustic cement bond evaluation data associated with each of the acoustic methods;

combining the output of each of the acoustic methods to generate an optimized cement bonding index log of the cement bond; and employing the optimized cement bonding index log to provide an interpretation of an overall cement bonding condition.

2. The method of claim 1, wherein the acoustic methods comprise an adjacent differential method, a polar differential method, a resonance-based method, or a casing guided wave based method.

3. The method of claim 1, wherein the cement bonding condition is characterized based on a bond index (BI) value and/or a bond index two-dimensional (2D) map, wherein the BI value 1 represents that the tubing is bound to cement, and wherein the BI value 0 represents that the tubing is free of bonding to the cement.

4. The method of claim 1, further comprising combining the output of each acoustic method using an empirical formula to generate the optimized cement bonding index log.

5. The method of claim 4, further comprising calculating the empirical formula by performing a weighted summation of weighted BI values of each of the acoustic methods.

6. The method of claim 4, further comprising calculating the empirical formula by comparing QC values of at least two acoustic methods, altering a weight of the QC value based on the comparison, and using an optimized weight in the weighted summation.

7. The method of claim 1, further comprising combining the output of each acoustic method employing a machine learning system to generate the optimized cement bonding index log, wherein the machine learning system implements supervised learning or unsupervised learning, wherein the supervised learning comprises random forests, gradient boosting, or support vector machines (SVM), and wherein the unsupervised learning comprises clustering and principal component analysis (PCA).

8. The method of claim 1, wherein the cement bonding condition depends on a plurality of cement bonding parameters, a configuration of the tubing, a configuration of the casing, a property of material behind the casing, a channel size, a channel direction, and/or a channel thickness.

9. The method of claim 8, wherein the configuration of the tubing comprises tubing outer diameter or tubing thickness, and wherein the configuration of the casing comprises casing outer diameter or casing thickness.

10. The method of claim 1, further comprising:

determining whether a difference between the overall cement bonding condition and a previously determined cement bonding condition is greater than a threshold; and in response to the determination, using the overall cement bonding condition as a reference input to each acoustic method to reevaluate the cement bonding condition.

11. The method of claim 1, wherein an output of a first acoustic method is used as an input of a second acoustic method.

12. The method of claim 1, wherein the QC value is represented by multi-dimensional equations, a combination of the multi-dimensional equations and a matrix, or a discretized representation, and wherein the QC value is predicted by simulation data, experimental data, or field data.

13. A system comprising:

an acoustic logging tool disposed within a tubing located inside a casing in a cased-borehole and comprising:

a transmitter configured to broadcast acoustic wave signals such that the acoustic wave signals interact with the cased-borehole; and a receiver configured to receive the acoustic wave signals;

a processor; and a non-transitory computer-readable medium having instructions stored thereon that are executable by the processor to cause the system to:

obtain acoustic cement bond evaluation data relating to a property of a cement bond of the cased-borehole for each of a plurality of acoustic methods by processing the received acoustic wave signals, wherein the acoustic cement bond evaluation data comprises a quality control (QC) value indicative of a confidence level of cement bonding conditions;

determine an eccentricity value of the tubing relative to the casing in a borehole, wherein the eccentricity value provides a direction and a magnitude of the tubing relative to the casing, wherein the eccentricity value varies between 0% to 100%, wherein the eccentricity value 0% indicates that the tubing is centered in the casing, and wherein the eccentricity value 100% indicates that the tubing is touching a wall of the casing;

determine an output of each acoustic method by combining the eccentricity value and the acoustic cement bond evaluation data associated with each of the acoustic methods;

combine the output of each of the acoustic methods to generate an optimized cement bonding index log; and employ the optimized cement bonding index log to provide an interpretation of an overall cement bonding condition.

14. The system of claim 13, wherein the acoustic methods comprise an adjacent differential method, a polar differential method, a resonance-based method, or a casing guided wave based method.

15. The system of claim 13, wherein the cement bonding condition is characterized based on a bond index (BI) value and/or a bond index two-dimensional (2D) map, wherein the BI value 1 represents the tubing is bound to cement, and wherein the BI value 0 represents the tubing is free of bonding to the cement.

16. A well measurement system, comprising:

an acoustic logging tool deployed in a cased-borehole in which a production tubing is installed within cement and casing, wherein the acoustic logging tool comprises:

at least one transmitter configured to broadcast acoustic wave signals such that the acoustic wave signals interact with the cased-borehole; and at least one receiver configured to receive the acoustic wave signals; and an information handling system configured to:

obtain acoustic cement bond evaluation data relating to a property of a cement bond for each of a plurality of acoustic methods by processing the received acoustic wave signals, wherein the acoustic cement bond evaluation data comprises a quality control (QC) value indicative of a confidence level of cement bonding conditions;

determine an eccentricity value of the production tubing relative to the casing in the cased-borehole, wherein the eccentricity value provides a direction and a magnitude of the production tubing relative to the casing, wherein the eccentricity value varies between 0% to 100%, wherein the eccentricity value 0% indicates that the tubing is centered in the casing, and wherein the eccentricity value 100% indicates that the tubing is touching a wall of the casing;

determine an output of each acoustic method by combining the eccentricity value and the acoustic cement bond evaluation data associated with each of the acoustic methods;

combine the output of each of the acoustic methods to generate an optimized cement bonding index log; and employ the optimized cement bonding index log to provide an interpretation of an overall cement bonding condition.

17. The well measurement system of claim 16, wherein the transmitter is a monopole, a dipole, a quadrupole, a higher azimuthal order source, or a source with an asymmetrical radiation pattern.

18. The well measurement system of claim 16, wherein the information handling system comprises a processor at a surface of the cased-borehole.

19. The well measurement system of claim 16, wherein the acoustic wave signals are transmitted and received at one or more depths with the cased-borehole.

20. The well measurement system of claim 16, wherein the acoustic methods comprise an adjacent differential method, a polar differential method, a resonance-based method, or a casing guided wave based method.

* * * * *